US010043434B2

(12) United States Patent
Jung et al.

(10) Patent No.: US 10,043,434 B2
(45) Date of Patent: Aug. 7, 2018

(54) GAMMA VOLTAGE GENERATOR AND DISPLAY DEVICE HAVING THE SAME

(71) Applicant: SAMSUNG DISPLAY CO., LTD., Yongin-si, Gyeonggi-do (KR)

(72) Inventors: Yeon-Shil Jung, Cheonan-si (KR); Tae-Wook Kim, Cheonan-si (KR)

(73) Assignee: Samsung Display Co., Ltd., Yongin-Si, Gyeonggi-do (KR)

( * ) Notice: Subject to any disclaimer, the term of this patent is extended or adjusted under 35 U.S.C. 154(b) by 270 days.

(21) Appl. No.: 15/149,204

(22) Filed: May 9, 2016

(65) Prior Publication Data

US 2017/0053581 A1 Feb. 23, 2017

(30) Foreign Application Priority Data

Aug. 18, 2015 (KR) ..... 10-2015-0115772

(51) Int. Cl.
*G09G 5/10* (2006.01)
*G09G 3/20* (2006.01)

(52) U.S. Cl.
CPC ..... *G09G 3/2003* (2013.01); *G09G 3/2007* (2013.01); *G09G 5/10* (2013.01); *G09G 2310/027* (2013.01); *G09G 2320/0276* (2013.01); *G09G 2320/0673* (2013.01); *G09G 2330/028* (2013.01)

(58) Field of Classification Search
CPC ..... G09G 3/2003; G09G 3/2007; G09G 5/10; G09G 2310/027
USPC ..... 345/690
See application file for complete search history.

(56) References Cited

U.S. PATENT DOCUMENTS

2007/0046600 A1* 3/2007 Sun ..... G09G 3/3688 345/89
2010/0039455 A1* 2/2010 Ahn ..... G09G 3/3648 345/690
2011/0012882 A1* 1/2011 Jeong ..... G09G 3/3688 345/211
2013/0002641 A1* 1/2013 Kim ..... G09G 3/3685 345/212
2013/0135272 A1* 5/2013 Park ..... G09G 3/3233 345/211
2016/0117992 A1* 4/2016 Park ..... G09G 3/3275 345/690

FOREIGN PATENT DOCUMENTS

KR 10-2015-0007061 A 1/2015

* cited by examiner

*Primary Examiner* — Jonathan Blancha
(74) *Attorney, Agent, or Firm* — Lee & Morse, P.C.

(57) ABSTRACT

A gamma voltage generator includes a reference gamma selector, a reference gamma converter, and a gamma curve adjuster. The reference gamma selector selects a top reference gamma voltage and a bottom reference gamma voltage that are between first and second reference voltages. The reference gamma converter converts the bottom reference gamma voltage to a conversion reference gamma voltage based on the top reference gamma voltage. The gamma curve adjuster generates a plurality of grayscale gamma voltages based on the conversion reference gamma voltage and the top reference gamma voltage.

20 Claims, 9 Drawing Sheets

GAMMA VOLTAGE GENERATOR AND DISPLAY DEVICE HAVING THE SAME

CROSS REFERENCE TO RELATED APPLICATION

Korean Patent Application No. 10-2015-0115772, filed on Aug. 18, 2015, and entitled, "Gamma Voltage Generator and Display Device Having the Same," is incorporated by reference herein in its entirety.

BACKGROUND

1. Field

One or more embodiments described herein relate to a gamma voltage generator and a display device having a gamma voltage generator.

2. Description of the Related Art

A display device includes a data driver to drive the pixels of a display panel. One type of data driver converts digital image to analog data based on grayscale gamma voltages output from a gamma voltage generator. The gamma voltage generator may adjust grayscale gamma voltages to achieve a desired dimming level. This may produce a corresponding change in luminance. However, if the gamma voltage generator has a cascade structure, luminance reversal dimming (in which the luminance increases as the dimming level increases) may occur. This may result from calculating lower grayscale gamma voltages based on one or more upper grayscale gamma voltages.

SUMMARY

In accordance with one or more embodiments, a gamma voltage generator includes a reference gamma selector to receive a first reference voltage and a second reference voltage and to select a top reference gamma voltage and a bottom reference gamma voltage between the first and second reference voltages; a reference gamma converter to convert the bottom reference gamma voltage to a conversion reference gamma voltage based on the top reference gamma voltage; and a gamma curve adjuster to generate a plurality of grayscale gamma voltages based on the conversion reference gamma voltage and the top reference gamma voltage.

The reference gamma selector may select the top reference gamma voltage such that the top reference gamma voltage increases as a dimming level increases. The reference gamma converter may adjust the conversion reference gamma voltage such that the conversion reference gamma voltage decreases as the top reference gamma voltage increases. The conversion reference gamma voltage may linearly decrease as the top reference gamma voltage increases.

The reference gamma selector may include a reference resistance string to distribute the first reference voltage and the second reference voltage; a first reference selector to select one of the voltages distributed by the reference resistance string as the bottom reference gamma voltage based on a bottom selection signal; and a second reference selector to select one of the voltages distributed by the reference resistance string as the top reference gamma voltage based on a top selection signal.

The gamma curve adjuster may include a first median gamma selector to receive the conversion reference gamma voltage and the top reference gamma voltage and to select a plurality of median gamma voltages between the conversion reference voltage and the top reference voltage; and a grayscale gamma output to output the grayscale gamma voltages by distributing the median gamma voltages. The first median gamma selector may include third through (N)th stages that are dependently connected, where N is an integer greater than 3, and a (K)th stage may includes a (K)th median resistance string is to distribute the conversion reference gamma voltage and a (K+1)th median gamma voltage output by a (K+1)th stage; and a (K)th selector to select one of the voltages distributed by the (K)th median resistance string as a (K)th median gamma voltage based on a (K)th median selection signal, K is an integer between 3 and (N−1).

The gamma curve adjuster may include a second median gamma selector to receive the first reference voltage and a third median gamma voltage output by the third stage and to select at least one of the voltages between the first reference voltage and the third median gamma voltage as a median gamma voltage.

The second median gamma selector may include a first stage and a second stage, the first stage includes a first median resistance string to distribute the first reference voltage and a second median gamma voltage output by the second stage, a first median selector to select one of the voltages distributed by the first median resistance string as a first median gamma voltage based on a first median selection signal, and the second stage may includes a second median resistance string to distribute the maximum reference voltage and the third median gamma voltage, and a second median selector to select one of voltages distributed by the second median resistance string as a second median gamma voltage based on a second median selection signal.

In accordance with one or more other embodiments, a display device includes a display panel including a plurality of pixels; a scan driver to provide a scan signal to the pixels; a gamma voltage generator to output a plurality of grayscale gamma voltages corresponding to a dimming level; a data driver to generate a data signal based on the grayscale gamma voltages and to provide the data signal to the pixels; and a controller to control the scan driver, the gamma voltage generator, and the data driver, wherein the gamma voltage generator includes: a reference gamma selector to receive a first reference voltage and a second reference voltage and to select a top reference gamma voltage and a bottom reference gamma voltage between the first and second reference voltages; a reference gamma converter to convert the bottom reference gamma voltage to a conversion reference gamma voltage based on the top reference gamma voltage; and a gamma curve adjuster to generate the grayscale gamma voltages based on the conversion reference gamma voltage and the top reference gamma voltage.

The reference gamma selector may select the top reference gamma voltage such that the top reference gamma voltage increases as a dimming level increases. The reference gamma converter may adjust the conversion reference gamma voltage such that the conversion reference gamma voltage decreases as the top reference gamma voltage increases. The conversion reference gamma voltage may linearly decrease as the top reference gamma voltage increases.

The reference gamma selector may include a reference resistance string to distribute the first reference voltage and the second reference voltage; a first reference selector to select one of the voltages distributed by the reference resistance string as the bottom reference gamma voltage based on a bottom selection signal; and a second reference selector to select one of the voltages distributed by the reference resistance string as the top reference gamma voltage based on a top selection signal. The controller may adjust the top selection signal such that the top reference gamma voltage increases as the dimming level increases.

The gamma curve adjuster may include a first median gamma selector to receive the conversion reference gamma voltage and the top reference gamma voltage and to select a plurality of median gamma voltages between the conversion reference voltage and the top reference voltage; and a grayscale gamma output to output the grayscale gamma voltages by distributing the median gamma voltages.

The first median gamma selector may include third through (N)th stages that are dependently connected, where N is an integer greater than 3, and a (K)th stage may include a (K)th median resistance string to distribute the conversion reference gamma voltage and a (K+1)th median gamma voltage outputted by a (K+1)th stage; and a (K)th selector to select one of the voltages by distributed the (K)th median resistance string as a (K)th median gamma voltage based on a (K)th median selection signal, where K is an integer between 3 and (N−1).

The controller may adjust the (K)th median selection signal when the dimming level is changed. The gamma curve adjuster may include a second median gamma selector to receive the first reference voltage and a third median gamma voltage output by the third stage and to select at least one of the voltages between the first reference voltage and the third median gamma voltage as a median gamma voltage.

The second median gamma selector may include a first stage and a second stage, the first stage may include a first median resistance string to distribute the first reference voltage and a second median gamma voltage output by the second stage, and a first median selector to select one of the voltages distributed by the first median resistance string as a first median gamma voltage based on a first median selection signal, and the second stage may include a second median resistance string to distribute the first reference voltage and the third median gamma voltage, and a second median selector to select one of the voltages distributed by the second median resistance string as a second median gamma voltage based on a second median selection signal.

BRIEF DESCRIPTION OF THE DRAWINGS

Features will become apparent to those of skill in the art by describing in detail exemplary embodiments with reference to the attached drawings in which.

DETAILED DESCRIPTION

Figure 1:
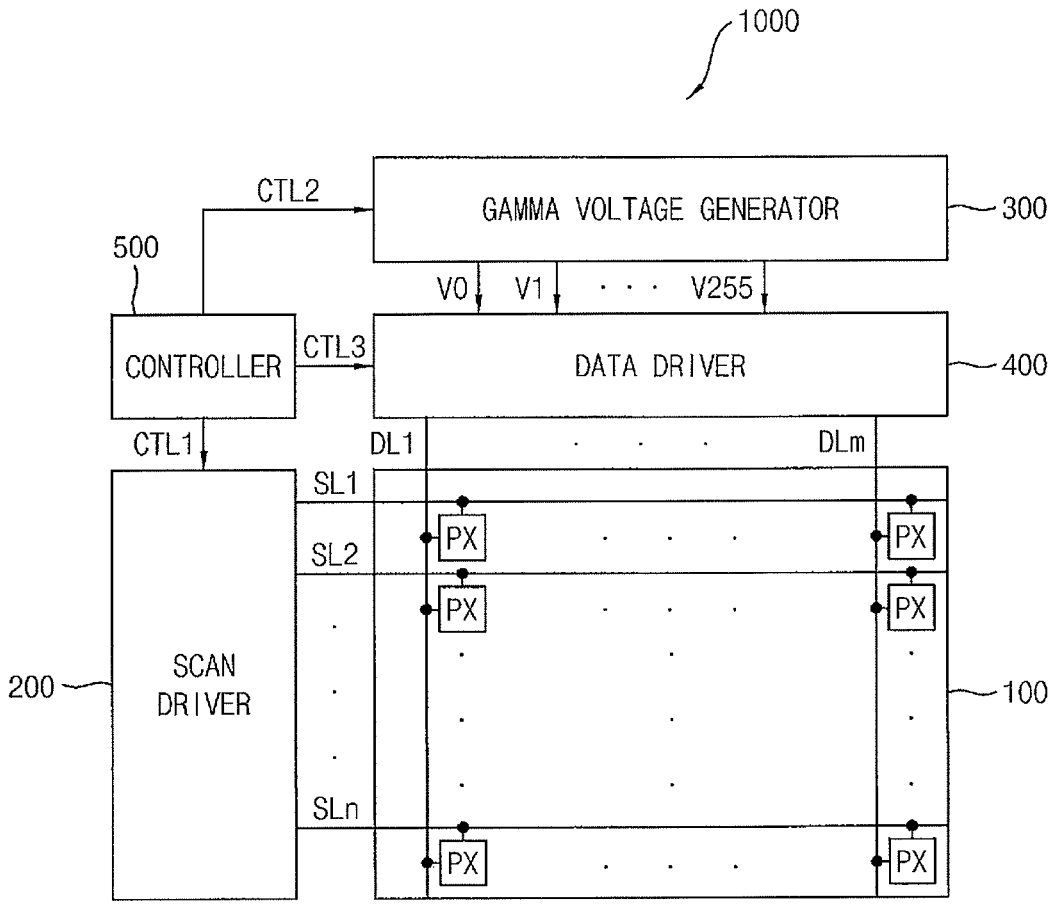
FIG. 1 illustrates an embodiment of a display device.

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art. The embodiments may be combined to form additional embodiments.

In the drawing figures, the dimensions of layers and regions may be exaggerated for clarity of illustration. It will also be understood that when a layer or element is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. Like reference numerals refer to like elements throughout.

FIG. 1 illustrates an embodiment of a display device 1000 which includes a display panel 100, a scan driver 200, a gamma voltage generator 300, a data driver 400, and a controller 500. The display panel 100 is connected to the scan driver 200 via scan lines SL1 through SLn. The display panel 100 is connected to the data driver 400 via data lines DL1 through DLm. The display panel 100 also includes n*m pixels PX at intersections of the scan lines SL1 through SLn and the data lines DL1 through DLm.

The scan driver 200 provides scan signals to the pixels PX via the scan lines SL1 through SLn based on a first control signal CTL1.

The gamma voltage generator 300 outputs grayscale gamma voltages V0 through V255 corresponding to a dimming level. The gamma voltage generator 300 may increase a top reference gamma voltage as the dimming level increases (e.g., as luminance decreases) based on a second control signal CTL2 having a dimming signal. The gamma voltage generator 300 may convert a bottom reference gamma voltage to a conversion reference gamma voltage in a manner that allows the conversion reference gamma voltage to decrease as the top reference gamma voltage increases.

Thus, the gamma voltage generator 300 may adjust the conversion reference gamma voltage for generating median gamma voltages according to a variation of the top reference gamma voltage. This may correct or reduce adverse effects associated with the luminance reversal problem.

In one example embodiment, the gamma voltage generator 300 may include a reference gamma selector, a reference gamma converter, and a gamma curve adjuster. The reference gamma selector may receive a maximum reference voltage and a minimum reference voltage and may select a top reference gamma voltage and a bottom reference gamma voltage between the maximum and minimum reference voltages. The reference gamma converter may convert the bottom reference gamma voltage to the conversion reference gamma voltage based on the top reference gamma voltage. The gamma curve adjuster may generate the grayscale gamma voltages V0 through V255 based on the conversion reference gamma voltage and the top reference gamma voltage.

The data driver 400 may generate a data signal based on the grayscale gamma voltages V0 through V255. The data driver 400 may provide the data signal to the pixels PX via the data lines DL1 through DLm based on a third control signal CTL3.

The controller 500 may generate the first through third control signals CTL1 through CTL3 to control the scan driver 200, the gamma voltage generator 300, and the data driver 400. When the dimming level is changed by an input signal received from user or external source, the controller 500 may provide the dimming signal to the gamma voltage generator 300 to change the gamma curve. In one example embodiment, the controller 500 may adjust a top selection signal such that the top reference gamma voltage increases as the dimming level increases. Also, the controller 500 may adjust a bottom selection signal and a plurality of median selection signals when the dimming level is changed.

The display device 1000 may include a power supply providing power source voltages to the display panel 100, the scan driver 200, the gamma voltage generator 300, and the data driver 400. Although the example embodiments of FIG. 1 describe that the dimming signal is provided from the controller, the dimming signal may be provided from a different source or circuit in another embodiment.

Therefore, by including the gamma voltage generator 300, the display device 1000 may adjust the dimming level with a reduced or minimized number of luminance reversal dimming sections.

Figure 2:
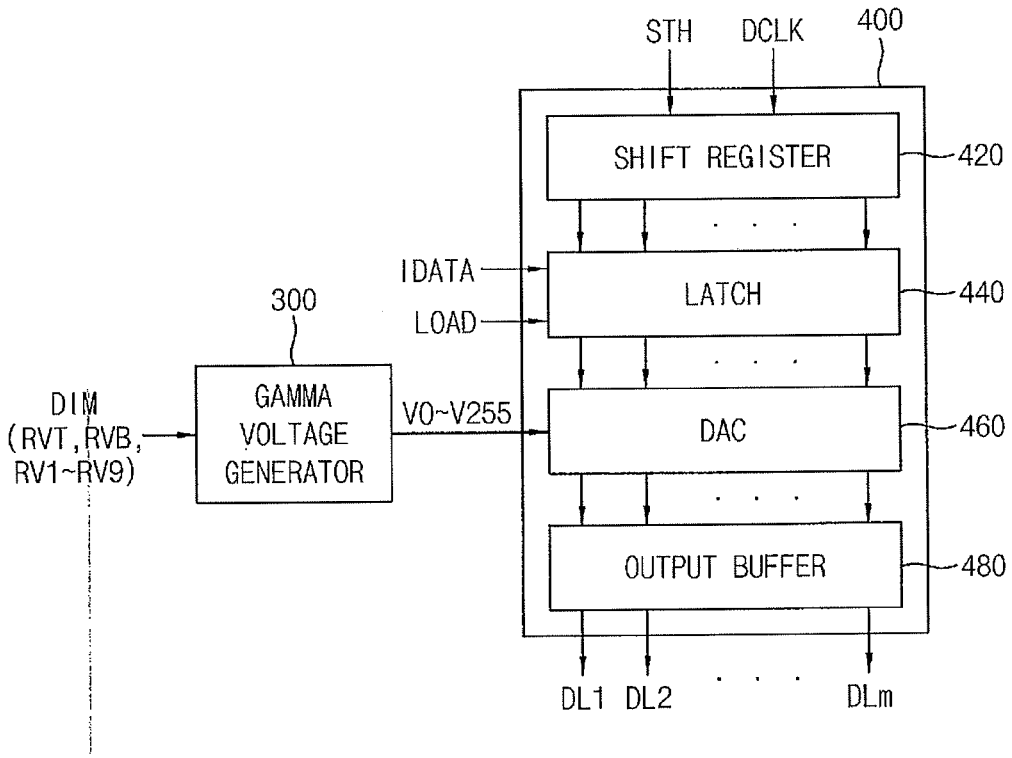
FIG. 2 illustrates an embodiment of a data driver.

FIG. 2 illustrates an embodiment of the data driver 400 which includes a shift register 420, a latch circuit 440, a digital-analog converter 460, and an output buffer 480. The shift register 420 may receive a horizontal start signal STH and a data clock signal DCLK. The shift register 420 may shift the horizontal start signal STH synchronizing the data clock signal DCLK to generate a sampling signal.

The latch circuit 440 may latch input data IDATA in response to the sampling signal. The latch circuit 440 may output the latched input data in response to a load signal LOAD.

The digital-analog converter 460 may convert the latched input data to the data signal based on grayscale gamma voltages V0 through V255. For example, the gamma voltage generator 300 may receive a dimming signal DIM, that is adjusted according to a dimming level from a controller, and may output grayscale gamma voltages V0 through V255 corresponding to the dimming signal. The digital-analog converter 460 may convert digital input data to analog data signals based on the received grayscale gamma voltages V0 through V255. Therefore, the digital-analog converter 460 may generate the data signals such that the luminance decreases as the dimming level increases.

The output buffer 480 may output the data signal from the digital-analog converter 460 to the data lines DL1 through DLm. The data driver 400 in the example embodiment of FIG. 4 includes the shift register 420, the latch circuit 440, the digital-analog converter 460, and the output buffer 480. However, the data driver 400 may have a different structure in another embodiment.

Figure 3:
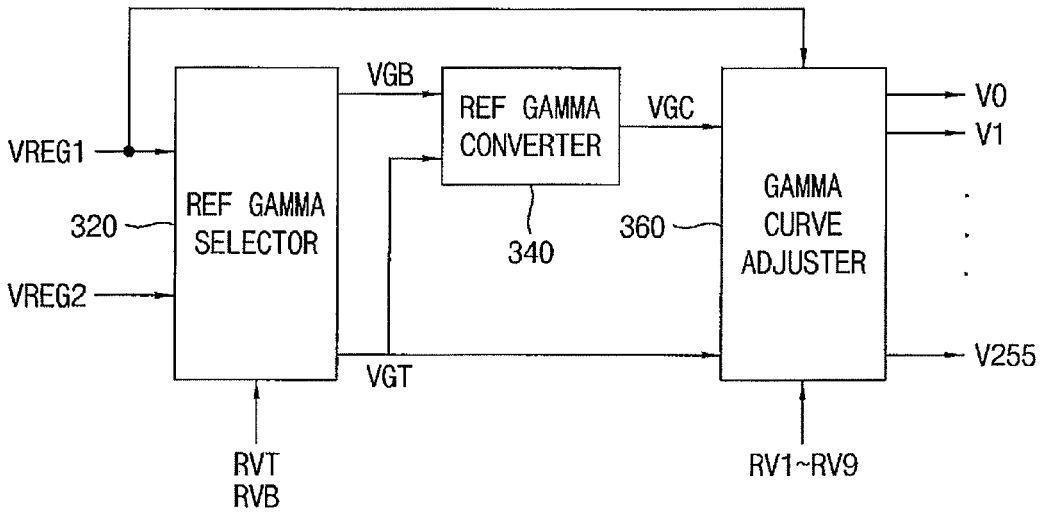
FIG. 3 illustrates an embodiment of a gamma generator.
Figure 4:
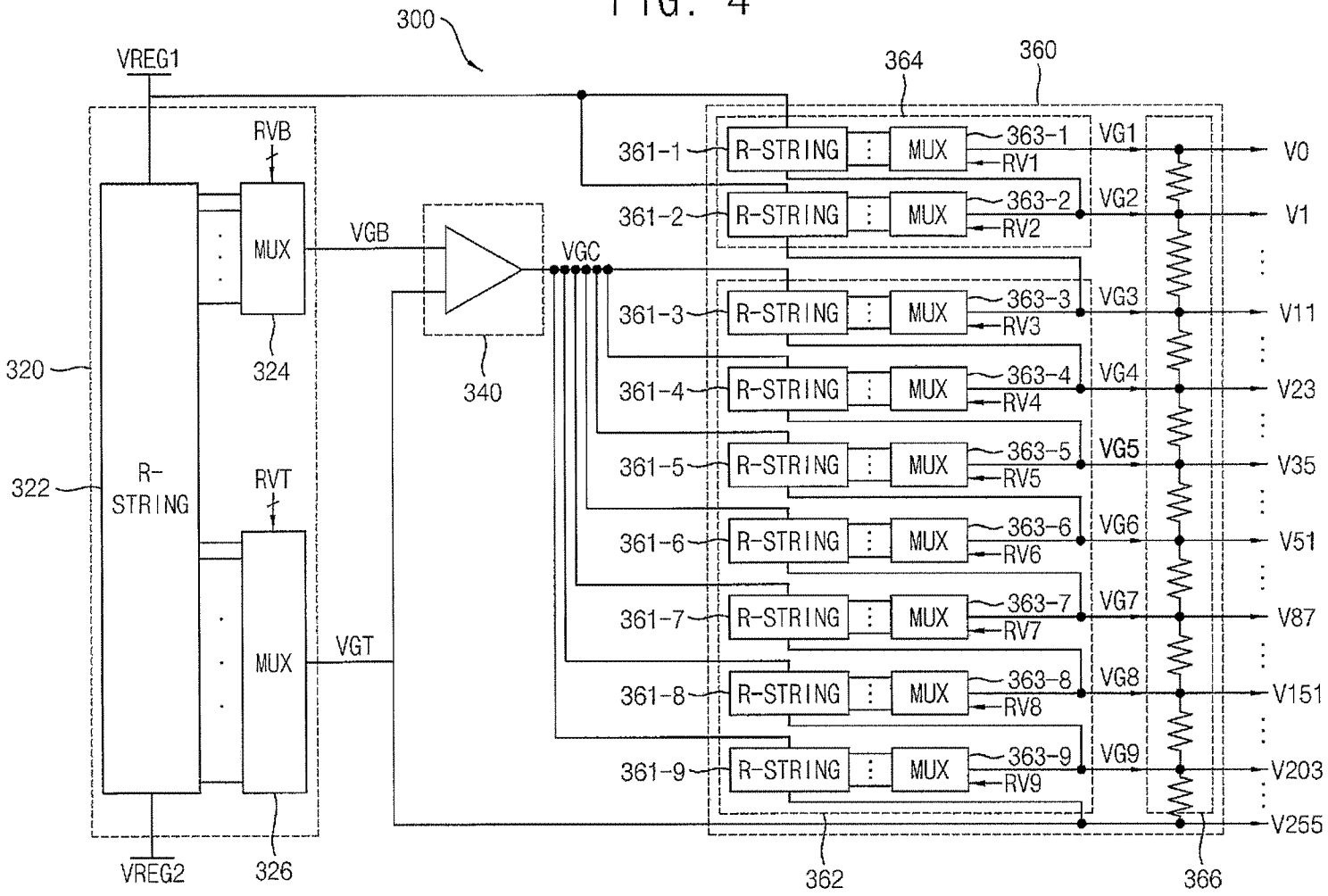
FIG. 4 illustrates an example of a circuit of the gamma generator.

FIG. 3 illustrates an embodiment of the gamma voltage generator 300, and FIG. 4 illustrates an example of a circuit of the gamma voltage generator 300.

Referring to FIGS. 3 and 4, the gamma voltage generator 300 includes a reference gamma selector 320, a reference gamma converter 340, and a gamma curve adjuster 360. The reference gamma selector 320 may receive a first reference voltage VREG1 and a second reference voltage VREG2 and select a top reference gamma voltage VGT and a bottom reference gamma voltage VGB between the first and second reference voltages VREG1 and VREG2. In one embodiment, the first and second reference voltages may be maximum and minimum reference voltages VREG1 and VREG2. In another embodiment, the first and second reference voltages may be other voltages. The top reference gamma voltage VGT and the bottom reference gamma voltage VGB may be used to generate median gamma voltages. In one example embodiment, the minimum reference voltage VREG2 may be a ground voltage or another reference voltage.

The reference gamma selector 320 may adjust the top reference gamma voltage VGT based on the dimming level. In one example embodiment, the reference gamma selector 320 may select the top reference gamma voltage VGT such that the top reference gamma voltage VGT increases as the dimming level increases.

In one example embodiment, the reference gamma selector 320 may include a reference resistance string 322, a first reference selector 324, and a second reference selector 326.

The reference resistance string 322 may distribute the maximum reference voltage VREG1 and the minimum reference voltage VREG2. The maximum reference voltage VREG1 may be applied to one end of the reference resistance string 322. The minimum reference voltage VREG2 may be applied to the other end of the reference resistance string 322. The reference resistance string 322 may include a plurality of resistances (e.g., resistors) connected in series. A plurality of voltages may be distributed and output at the contact point of the resistances in the reference resistance string 322.

The first reference selector 324 may select one of the voltages distributed by the reference resistance string 322 as the bottom reference gamma voltage VGB based on a bottom selection signal RVB. For example, the first reference selector 324 may receive a plurality of voltages relatively near to (e.g., within a predetermined range from) the maximum reference voltage VREG1 from the reference resistance string 322. The first reference selector 324 may select and output the bottom reference gamma voltage VGB based on the bottom selection signal RVB. In one example embodiment, the first reference selector 324 may be a multiplexer that selects one of 8 input voltages. In this case, the bottom reference gamma voltage VGB may correspond to a 3 bit register value.

The second reference selector 326 may select one of the voltages distributed by the reference resistance string 322 as the top reference gamma voltage VGT based on a top selection signal RVT. For example, the second reference selector 326 may receive a plurality of voltages relatively near to (e.g. within a predetermined range from) the minimum reference voltage VREG2 from the reference resistance string 322. The second reference selector 326 may select and output the top reference gamma voltage VGT based on the top selection signal RVT. In one example embodiment, the second reference selector 326 may be a multiplexer that selects one of 255 input voltages. In this case, the top reference gamma voltage VGT may correspond to a 9 bit register value.

The reference gamma converter 340 may convert the bottom reference gamma voltage VGB to a conversion reference gamma voltage VGC based on the top reference gamma voltage VGT. Thus, the reference gamma converter 340 may adjust the conversion reference gamma voltage VGC for generating the median gamma voltages VG3 through VG9 according to a variation of the top reference gamma voltage VGT in order to correct or improve the luminance reversal problem.

In one example embodiment, the reference gamma converter 340 may adjust the conversion reference gamma voltage VGC such that the conversion reference gamma voltage VGC decreases as the top reference gamma voltage VGT increases. For example, the conversion reference gamma voltage VGC may linearly decrease as the top reference gamma voltage VGT increases. In one example embodiment, reference gamma converter 340 may include an amplifier.

The gamma curve adjuster 360 may generate the grayscale gamma voltages V0 through V255 based on the conversion reference gamma voltage VGC and the top reference gamma voltage VGT. The gamma curve adjuster 360 may distribute the conversion reference gamma voltage VGC and the top reference gamma voltage VGT and select the median gamma voltages VG1 through VG9 among the distributed voltages. The gamma curve adjuster 360 may generate the grayscale gamma voltages V0 through V255 from the median gamma voltages VG1 through VG9 and output the grayscale gamma voltages V0 through V255.

In one example embodiment, the gamma curve adjuster 360 may include a first median gamma selector 362, a second median gamma selector 364, and a grayscale gamma output 366. The first median gamma selector 362 may receive the conversion reference gamma voltage VGC and the top reference gamma voltage VGT and select a plurality of median gamma voltages (e.g., third through ninth median gamma voltages VG3 through VG9) between the conversion reference voltage VGC and the top reference voltage VGT.

The first median gamma selector 362 may include cascade stages. In one example embodiment, the first median gamma selector 362 may include third through (N)th stages that are dependently connected, where N is an integer greater than 3. The (K)th stage, where K is an integer between 3 and (N−1), may include a (K)th median resistance string and a (K)th selector. The (K)th median resistance string may distribute the conversion reference gamma voltage and a (K+1)th median gamma voltage output by a (K+1)th stage. The (K)th selector may select one of the voltages distributed by the (K)th median resistance string as a (K)th median gamma voltage based on a (K)th median selection signal.

For example, the third stage include the third median resistance string 361-3 distributing the conversion reference gamma voltage VGC and the fourth median gamma voltage VG4, and the third median selector 363-3 selecting one of the voltages distributed by the third median resistance string 361-3 as the third median gamma voltage VG3 based on the third median selection signal RV3. Also, the ninth stage (e.g., the top stage) may include the ninth median resistance string 361-9 distributing the conversion reference gamma voltage VGC and the top reference gamma voltage VGT, and the ninth median selector 363-9 selecting one of the voltages distributed by the ninth median resistance string 361-9 as the ninth median gamma voltage VG9 based on the ninth median selection signal RV9.

The second median gamma selector 364 may receive the maximum reference voltage VREG1 and the third median gamma voltage VG3 and select at least one of the voltages between the maximum reference voltage VREG1 and the third median gamma voltage VG3 as a median gamma voltage (e.g., the first median gamma voltage VG1 and the second median gamma voltage VG2). The 0 grayscale gamma voltage and 1 grayscale gamma voltage may be relatively far apart from other grayscale gamma voltages. Therefore, the gamma curve adjuster 360 may include the second median gamma selector 364 in addition to the first median gamma selector 362. Accordingly, the gamma curve adjuster 360 may generate and output the 0 grayscale gamma voltage and the 1 grayscale gamma voltage without a large resistance string, e.g., one having a relatively large number of resistances.

In one example embodiment, the second median gamma selector 364 may include a first stage and a second stage. The first stage include the first median resistance string 361-1 distributing the maximum reference voltage VREG1 and the second median gamma voltage VG2, and the first median selector 363-1 selecting one of the voltages distributed by the first median resistance string 361-1 as the first median gamma voltage VG1 based on the first median selection signal RV1. The second stage may include the second median resistance string 361-2 distributing the maximum reference voltage VREG1 and the third median gamma voltage VG3, and the second median selector 363-2 selecting one of the voltages distributed by the second median resistance string 361-2 as the second median gamma voltage VG2 based on the second median selection signal RV2.

The grayscale gamma output 366 may output the grayscale gamma voltages V0 through V255 by distributing the median gamma voltages VG1 through VG9. The grayscale gamma output 366 may generate the grayscale gamma voltages V0 through V255 by distributing the median gamma voltages VG1 through VG9 and the top reference gamma voltage VGT using the resistance string. The top reference gamma voltage VGT may be directly output as the 255 grayscale gamma voltage V255.

Figure 5:
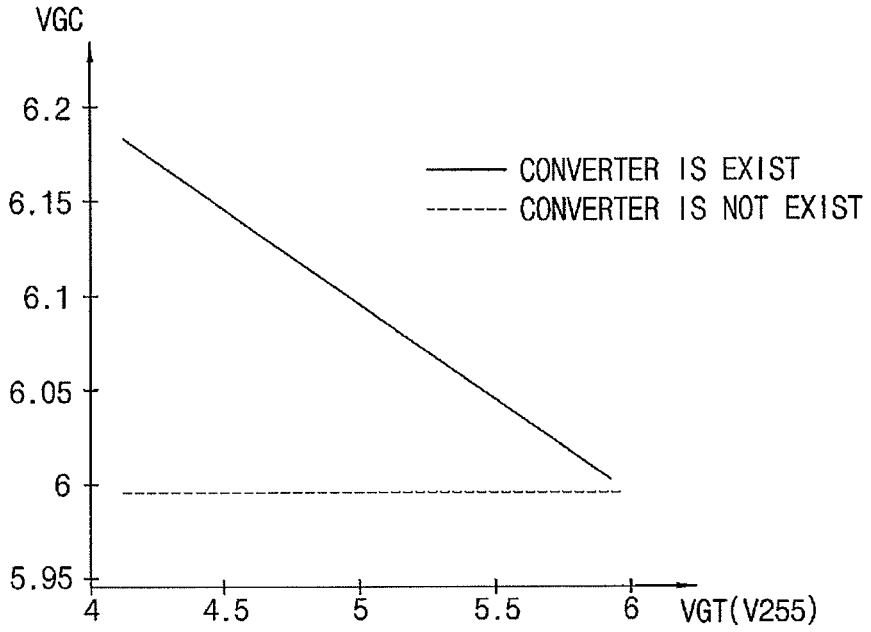
FIG. 5 illustrates an example of converting a bottom reference gamma voltage to a conversion reference gamma voltage.

FIG. 5 is a graph an example of how a bottom reference gamma voltage may be converted to a conversion reference gamma voltage. Referring to FIG. 5, the reference gamma converter in the gamma voltage generator may adjust a conversion reference gamma voltage according to a variation of the top reference gamma voltage in order to correct or improve the luminance reversal problem.

In one example embodiment, the reference gamma converter may adjust the conversion reference gamma voltage such that the conversion reference gamma voltage decreases as the top reference gamma voltage increases. In one embodiment, the conversion reference gamma voltage may linearly decrease as the top reference gamma voltage increases.

For example, when the minimum reference voltage is the ground voltage, the conversion reference gamma voltage may be calculated according to Equation 1.

$$VGC = VREG1 - \left\{(VREG1 - VGB) \times \frac{VGT}{(VREG1 - VGT)}\right\} \times K \tag{1}$$

where, VGC is the conversion reference gamma voltage, VREG1 is the maximum reference voltage, VGB is the bottom reference gamma voltage, VGT is the top reference gamma voltage (or the $255^{th}$ grayscale gamma voltage), and K is a constant value. In one embodiment, K may correspond to the slope of the curve which indicates a relationship between the top reference gamma voltage and the conversion reference gamma voltage.

Figure 6:
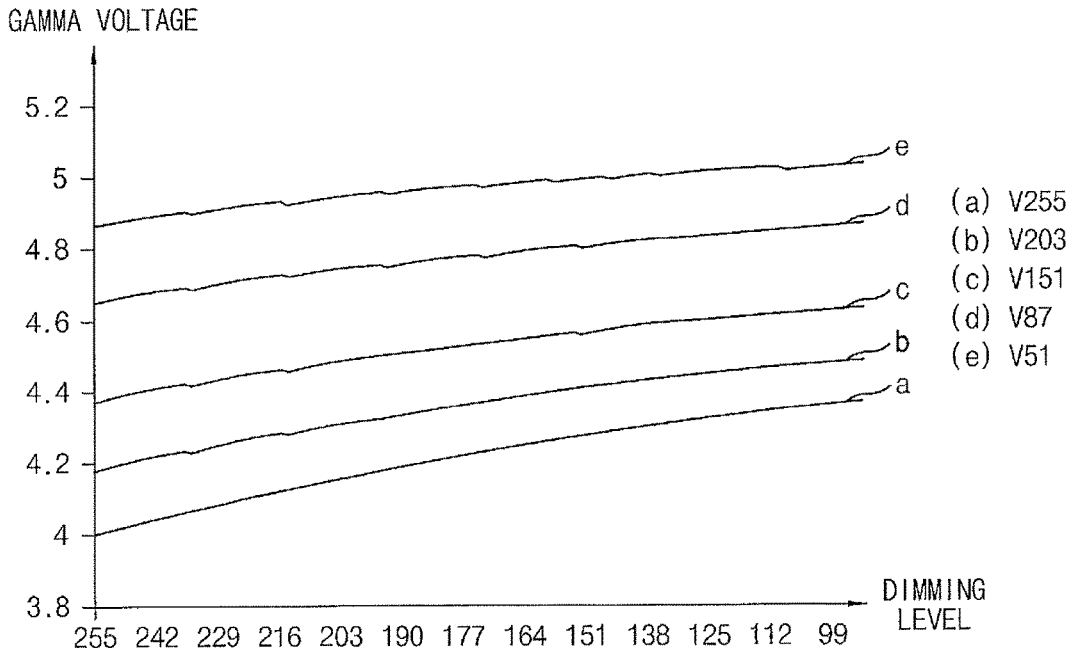
FIGS. 6 and 7 illustrate the occurrence of a luminance reversal problem in a comparative device.
Figure 7:
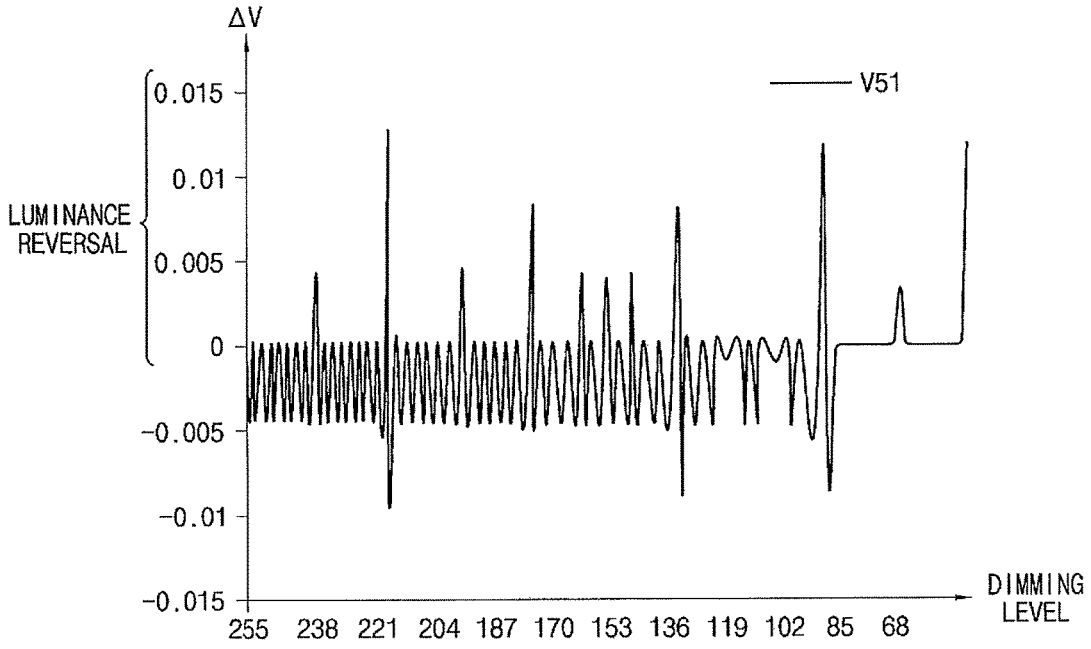
Figure 8:
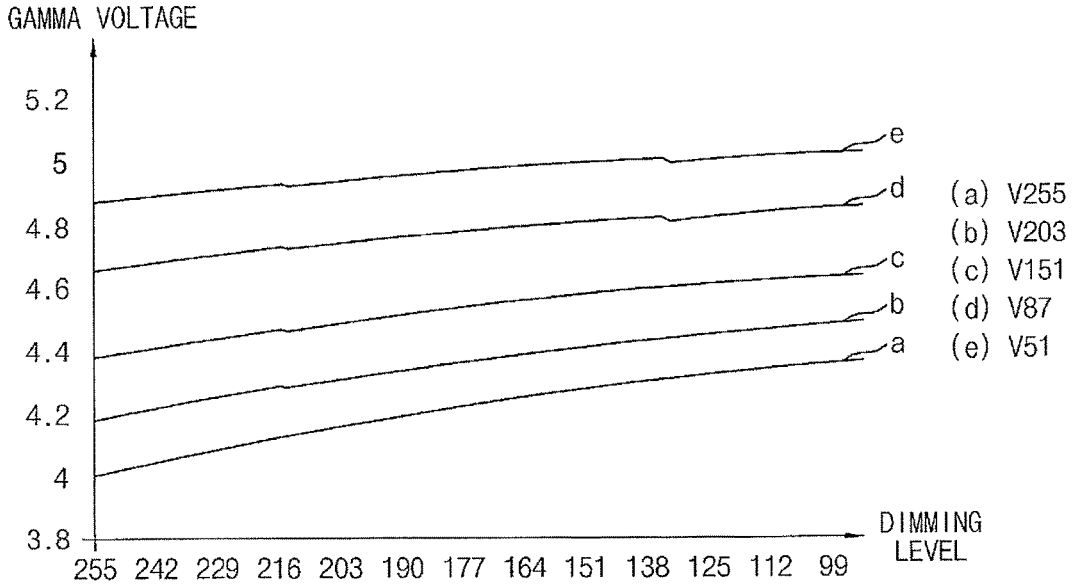
FIGS. 8 and 9 illustrate examples of how the luminance reversal problem may be corrected or improved in accordance with or more embodiments.
Figure 9:
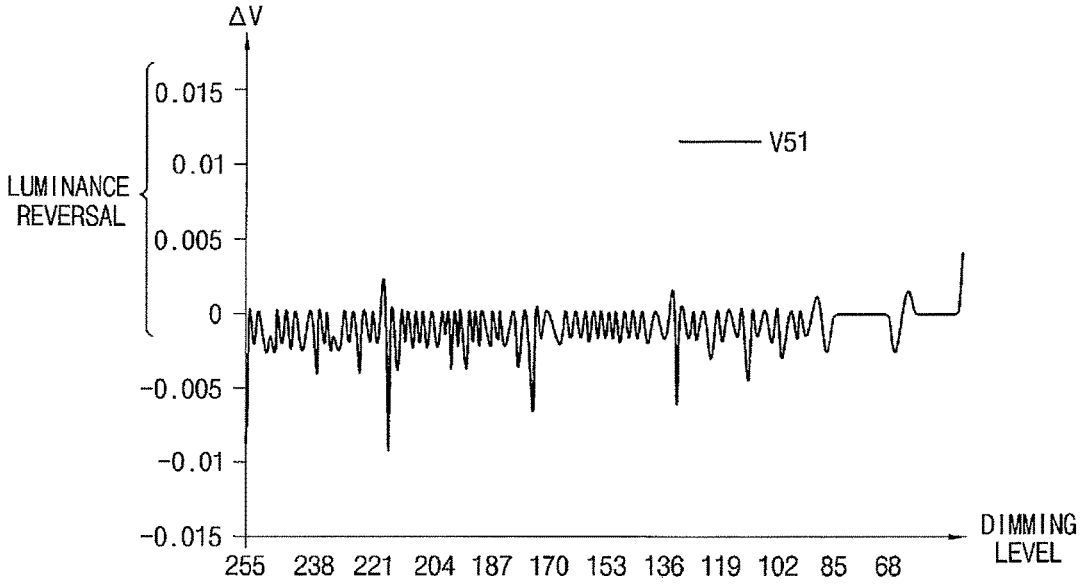

FIGS. 6 and 7 illustrate the occurrence of a luminance reversal problem in a comparative device, and FIGS. 8 and 9 illustrate examples of how the luminance reversal problem may be corrected or improved in a display device in accordance with any of the aforementioned embodiments.

Referring to FIGS. 6 through 7, when a gamma voltage generator includes a median gamma selector having cascade stages, a luminance reversal dimming section may occur because a lower grayscale gamma voltage is calculated using an upper grayscale gamma voltage. In accordance with one or more embodiments, the gamma voltage generator adjusts the conversion reference gamma voltage according to a variation of the top reference gamma voltage by including the reference gamma converter. Accordingly, the gamma voltage generator may correct or improve the luminance reversal problem.

As shown in FIGS. 6 and 7, a comparative gamma voltage generator generated median gamma voltages and grayscale gamma voltages based on a fixed bottom reference gamma voltage without the reference gamma converter. A $255^{th}$ grayscale gamma voltage V255 generated by the comparative gamma voltage generator did not have the luminance reversal dimming section when the dimming level is adjusted because the $255^{th}$ grayscale gamma voltage V255 is set to the top reference gamma voltage. However, other grayscale gamma voltages except for the $255^{th}$ grayscale gamma voltage V255 had the luminance reversal dimming sections because the lower grayscale gamma voltages are calculated using the upper grayscale gamma voltages.

For example, the $203^{rd}$ grayscale gamma voltage V203, $151^{st}$ grayscale gamma voltage V151, $87^{th}$ grayscale gamma voltage V87, and $51^{st}$ grayscale gamma voltage V51 generated by the comparative gamma voltage generator have the luminance reversal dimming sections when the dimming level is adjusted. A difference value ΔV is a first voltage corresponding to a first dimming level subtracted from a second voltage corresponding to a second dimming level lower than the first dimming level. Thus, the luminance reversal dimming section is a portion in which the luminance increases as the dimming level increases.

The luminance reversal dimming section indicates a portion in which the difference value ΔV has positive value. The luminance reversal dimming sections frequently occur in low grayscale gamma voltage in comparison with high grayscale gamma voltages. For example, the luminance reversal dimming sections for the $51^{st}$ grayscale gamma voltage V51 occur relatively frequently in comparison with the luminance reversal dimming sections for the $203^{rd}$ grayscale gamma voltage V203.

As shown in FIGS. 8 and 9, an experimental gamma voltage generator adjusted the conversion reference gamma voltage for generating median gamma voltages according to a variation of the top reference gamma voltage by including the reference gamma converter in accordance with one or more embodiments. The experimental gamma voltage generator generated median gamma voltages and grayscale gamma voltages based on the adjusted conversion reference gamma voltage. Thus, the experimental gamma voltage generator adjusted the conversion reference gamma voltage according to Equation 1, such that the top reference gamma voltage increases as the dimming level increases (e.g., as the luminance increases) and the conversion reference gamma voltage decreases as the top reference gamma voltage increases.

The experimental gamma voltage generator improves the luminance reversal problem that occurs due to the median gamma selector having a cascade structure, by adjusting the conversion reference gamma voltage according to the variation of top reference gamma voltage. For example, in the $203^{rd}$ grayscale gamma voltage V203, the $151^{st}$ grayscale gamma voltage V151, the $87^{th}$ grayscale gamma voltage V87, and the $51^{st}$ grayscale gamma voltage V51 generated by the experimental gamma voltage generator, the number of the luminance reversal dimming sections was significantly reduced compared to the comparative gamma voltage generator.

The embodiments described herein may be applied, for example, to an electronic device having an organic light emitting display device. Examples of the electronic device include a cellular phone, a smart phone, a smart pad, and a personal digital assistant.

The methods, processes, and/or operations described herein may be performed by code or instructions to be executed by a computer, processor, controller, or other signal processing device. The computer, processor, controller, or other signal processing device may be those described herein or one in addition to the elements described herein. Because the algorithms that form the basis of the methods (or operations of the computer, processor, controller, or other signal processing device) are described in detail, the code or instructions for implementing the operations of the method embodiments may transform the computer, processor, controller, or other signal processing device into a special-purpose processor for performing the methods described herein.

The controller and other processing features of the embodiments described herein may be implemented in logic which, for example, may include hardware, software, or both. When implemented at least partially in hardware, the controller and other processing features may be, for example, any one of a variety of integrated circuits including but not limited to an application-specific integrated circuit, a field-programmable gate array, a combination of logic gates, a system-on-chip, a microprocessor, or another type of processing or control circuit.

When implemented in at least partially in software, the controller and other processing features may include, for example, a memory or other storage device for storing code or instructions to be executed, for example, by a computer, processor, microprocessor, controller, or other signal processing device. The computer, processor, microprocessor, controller, or other signal processing device may be those described herein or one in addition to the elements described herein. Because the algorithms that form the basis of the methods (or operations of the computer, processor, microprocessor, controller, or other signal processing device) are described in detail, the code or instructions for implementing the operations of the method embodiments may transform the computer, processor, controller, or other signal processing device into a special-purpose processor for performing the methods described herein.

By way of summation and review, one type of data driver converts digital image to analog data based on grayscale gamma voltages output from a gamma voltage generator. The gamma voltage generator may adjust grayscale gamma voltages to achieve a desired dimming level. This may produce a corresponding change in luminance. However, if the gamma voltage generator has a cascade structure, luminance reversal dimming (in which the luminance increases as the dimming level increases) may occur. This may result from calculating lower grayscale gamma voltages based on one or more upper grayscale gamma voltages.

In accordance with one or more embodiments, a gamma voltage generator includes a reference gamma selector, a reference gamma converter, and a gamma curve adjuster. The reference gamma converter adjusts the conversion reference gamma voltage VGC according to a variation of the top reference gamma voltage VGT. Accordingly, the conversion reference gamma voltage VGC may linearly decrease as the top reference gamma voltage VGT increases. This may correct or reduce adverse effects of the luminance reversal problem.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims.

What is claimed is:

1. A gamma voltage generator, comprising:

a reference gamma selector to receive a first reference voltage and a second reference voltage and to select a top reference gamma voltage and a bottom reference gamma voltage between the first and second reference voltages;

a reference gamma converter to convert the bottom reference gamma voltage to a conversion reference gamma voltage based on the top reference gamma voltage; and a gamma curve adjuster to generate a plurality of grayscale gamma voltages based on the conversion reference gamma voltage and the top reference gamma voltage.

2. The gamma voltage generator as claimed in claim 1, wherein the reference gamma selector is to select the top reference gamma voltage such that the top reference gamma voltage increases as a dimming level increases.

3. The gamma voltage generator as claimed in claim 1, wherein the reference gamma converter is to adjust the conversion reference gamma voltage such that the conversion reference gamma voltage decreases as the top reference gamma voltage increases.

4. The gamma voltage generator as claimed in claim 3, wherein the conversion reference gamma voltage is to linearly decrease as the top reference gamma voltage increases.

5. The gamma voltage generator as claimed in claim 1, wherein the reference gamma selector includes:

a reference resistance string to distribute the first reference voltage and the second reference voltage;

a first reference selector to select one of the voltages distributed by the reference resistance string as the bottom reference gamma voltage based on a bottom selection signal; and a second reference selector to select one of the voltages distributed by the reference resistance string as the top reference gamma voltage based on a top selection signal.

6. The gamma voltage generator as claimed in claim 1, wherein the gamma curve adjuster includes:

a first median gamma selector to receive the conversion reference gamma voltage and the top reference gamma voltage and to select a plurality of median gamma voltages between the conversion reference voltage and the top reference voltage; and a grayscale gamma output to output the grayscale gamma voltages by distributing the median gamma voltages.

7. The gamma voltage generator as claimed in claim 6, wherein:

the first median gamma selector includes third through (N)th stages that are dependently connected, where N is an integer greater than 3, and a (K)th stage includes:

a (K)th median resistance string is to distribute the conversion reference gamma voltage and a (K+1)th median gamma voltage output by a (K+1)th stage; and a (K)th selector to select one of the voltages distributed by the (K)th median resistance string as a (K)th median gamma voltage based on a (K)th median selection signal, where K is an integer between 3 and (N−1).

8. The gamma voltage generator as claimed in claim 7, wherein the gamma curve adjuster includes:

a second median gamma selector to receive the first reference voltage and a third median gamma voltage output by the third stage and to select at least one of the voltages between the first reference voltage and the third median gamma voltage as a median gamma voltage.

9. The gamma voltage generator as claimed in claim 8, wherein:

the second median gamma selector includes a first stage and a second stage, the first stage includes a first median resistance string to distribute the first reference voltage and a second median gamma voltage output by the second stage, and a first median selector to select one of the voltages distributed by the first median resistance string as a first median gamma voltage based on a first median selection signal, and the second stage includes a second median resistance string to distribute the maximum reference voltage and the third median gamma voltage, and a second median selector to select one of voltages distributed by the second median resistance string as a second median gamma voltage based on a second median selection signal.

10. A display device, comprising:

a display panel including a plurality of pixels;

a scan driver to provide a scan signal to the pixels;

a gamma voltage generator to output a plurality of grayscale gamma voltages corresponding to a dimming level;

a data driver to generate a data signal based on the grayscale gamma voltages and to provide the data signal to the pixels; and a controller to control the scan driver, the gamma voltage generator, and the data driver, wherein the gamma voltage generator includes:

a reference gamma selector to receive a first reference voltage and a second reference voltage and to select a top reference gamma voltage and a bottom reference gamma voltage between the first and second reference voltages;

a reference gamma converter to convert the bottom reference gamma voltage to a conversion reference gamma voltage based on the top reference gamma voltage; and a gamma curve adjuster to generate the grayscale gamma voltages based on the conversion reference gamma voltage and the top reference gamma voltage.

11. The display device as claimed in claim 10, wherein the reference gamma selector is to select the top reference gamma voltage such that the top reference gamma voltage increases as a dimming level increases.

12. The display device as claimed in claim 10, wherein the reference gamma converter is to adjust the conversion reference gamma voltage such that the conversion reference gamma voltage decreases as the top reference gamma voltage increases.

13. The display device as claimed in claim 12, wherein the conversion reference gamma voltage is to linearly decrease as the top reference gamma voltage increases.

14. The display device as claimed in claim 10, wherein the reference gamma selector includes:

a reference resistance string to distribute the first reference voltage and the second reference voltage;

a first reference selector to select one of the voltages distributed by the reference resistance string as the bottom reference gamma voltage based on a bottom selection signal; and a second reference selector to select one of the voltages distributed by the reference resistance string as the top reference gamma voltage based on a top selection signal.

15. The display device as claimed in claim 14, wherein the controller is to adjust the top selection signal such that the top reference gamma voltage increases as a dimming level increases.

16. The display device as claimed in claim 10, wherein the gamma curve adjuster includes:

a first median gamma selector to receive the conversion reference gamma voltage and the top reference gamma voltage and to select a plurality of median gamma voltages between the conversion reference voltage and the top reference voltage; and a grayscale gamma output to output the grayscale gamma voltages by distributing the median gamma voltages.

17. The display device as claimed in claim 16, wherein:

the first median gamma selector includes third through (N)th stages that are dependently connected, where N is an integer greater than 3, and a (K)th stage includes:

a (K)th median resistance string to distribute the conversion reference gamma voltage and a (K+1)th median gamma voltage outputted by a (K+1)th stage; and a (K)th selector to select one of the voltages by distributed the (K)th median resistance string as a (K)th median gamma voltage based on a (K)th median selection signal, where K is an integer between 3 and (N−1).

18. The display device as claimed in claim 17, wherein the controller is to adjust the (K)th median selection signal when the dimming level is changed.

19. The display device as claimed in claim 17, wherein the gamma curve adjuster includes:

a second median gamma selector to receive the first reference voltage and a third median gamma voltage output by the third stage and to select at least one of the voltages between the first reference voltage and the third median gamma voltage as a median gamma voltage.

20. The display device as claimed in claim 19, wherein:

the second median gamma selector includes a first stage and a second stage, the first stage includes a first median resistance string to distribute the first reference voltage and a second median gamma voltage output by the second stage, and a first median selector to select one of the voltages distributed by the first median resistance string as a first median gamma voltage based on a first median selection signal, and the second stage includes a second median resistance string to distribute the first reference voltage and the third median gamma voltage, and a second median selector to select one of the voltages distributed by the second median resistance string as a second median gamma voltage based on a second median selection signal.

* * * * *